US006209467B1

(12) United States Patent
Tomita

(10) Patent No.: US 6,209,467 B1
(45) Date of Patent: Apr. 3, 2001

(54) PATTERN DATA READING APPARATUS FOR SEWING MACHINE

(75) Inventor: Shintaro Tomita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/603,974

(22) Filed: Jun. 26, 2000

(30) Foreign Application Priority Data

Jun. 30, 1999 (JP) ..... 11-185239

(51) Int. Cl.[7] ..... D05B 21/00; D05C 5/06

(52) U.S. Cl. ..... 112/102.5; 112/475.19; 700/138

(58) Field of Search ..... 112/102.5, 470.04, 112/470.06, 475.19, 456, 457, 458; 700/136, 137, 138

(56) References Cited

U.S. PATENT DOCUMENTS 5,383,413 * 1/1995 Hayashi ..... 112/102.5
5,896,822 * 4/1999 Futamura ..... 112/102.5
5,947,043 * 9/1999 Morita et al. ..... 112/102.5
5,974,992 * 11/1999 Asano ..... 112/102.5

FOREIGN PATENT DOCUMENTS 5-123471 5/1993 (JP) .
2-2561650 9/1996 (JP) .

* cited by examiner

*Primary Examiner*—Peter Nerbun
(74) *Attorney, Agent, or Firm*—Oliff & Berridge, PLC

(57) ABSTRACT

In a sewing machine, a reading device reads embroidery or pattern data provided from outside of the apparatus and writes the read data into a memory, and a cancel device cancels the reading of the data during the reading of the data. Therefore, even if the reading of the data is mistakenly started, the reading process can be canceled when an operator notices the mistake. Thus, as the operator does not need to wait until the reading is completed, the operability and workability can be greatly improved.

39 Claims, 15 Drawing Sheets

[PATTERN NAME DATA AND ASSOCIATED INFORMATION DATA READING CONTROL]

PATTERN DATA READING APPARATUS FOR SEWING MACHINE

BACKGROUND OF THE INVENTION

1. Field of Invention

The invention relates to an embroidery data reading apparatus for a sewing machine and, more particularly, to an embroidery, or pattern, data reading apparatus that can read embroidery, or pattern, data from outside of the apparatus and cancel the reading of embroidery, or pattern, data during the reading.

2. Description of Related Art

Conventionally, an electronically-controlled sewing machine with an embroidery function has an embroidery frame driving mechanism that moves and drives an embroidery frame independently in crosswise directions. The sewing machine is designed to actuate a machine motor and the embroidery frame driving mechanism based on sewing data for a desired embroidery pattern selected via a display, thereby to embroider the pattern on a work cloth set in the embroidery frame, using a plurality of color threads.

In Japanese Laid-Open Patent Publication No. 5-123471 and Japanese Patent No. 2561650, the applicant suggests a sewing machine designed to store a plurality of sets of pattern data (including display data used for displaying a pattern on the display and sewing data for forming stitches) related to embroidery patterns in a ROM provided in the controller or a detachable ROM card, thereby listing embodiments of the embroidery patterns on the display to select a desired pattern and embroidering the pattern.

Some suppliers, who create and sell various colorful embroidery patterns, such as a flower and an animal, create sewing data for new embroidery patterns using an embroidery pattern creating device or embroidery pattern editing system which is made up of a personal computer. They create display data for the new embroidery patterns, link the sewing data and the display data with pattern names, write them into a floppy disk via a floppy disk drive, and sell the embroidery floppy disk.

Therefore, a recent electronically-controlled sewing machine for domestic use is equipped with a floppy disk drive to read a purchased embroidery floppy disk. In this manner, a desired embroidery pattern stored in the floppy disk can be embroidered easily at a lower price compared to those in a ROM card. In this case, a plurality of embroidery pattern names are shown by a list during pattern selection. When a pattern name is selected from the list, its display data and sewing data are read successively. The pattern is displayed based on the display data. After the sewing data is completely read, the sewing is started.

As described above, in the electronically-controlled sewing machine, for domestic or home use, disclosed in Japanese Laid-Open Patent Publication No. 5-123471 and Japanese Patent No. 2561650, data are stored in a ROM provided in the controller of the machine or in a ROM card. While the display data and moving data for a selected embroidery pattern are read therefrom, the reading can not be canceled. Even if the pattern selected by mistake has a lot of stitches, the operator has to wait until the reading is completed.

In this kind of sewing machine equipped with a mechanical storage medium, such as a floppy disk drive, especially when the display data and the sewing data for the selected pattern are read from the floppy disk, the head-load time and the seek time for a reading address are required. As a result, the data read-in speed of the floppy disk becomes lower than that of a ROM. If the operator notices the pattern has been selected by mistake during the reading of the sewing data for the pattern, the reading can not be canceled halfway. And what is even worse, the operator has to wait without doing anything until the reading is completed. In particular, when the pattern being read has a lot of stitches to be sewn, the time the operator has to wait becomes longer. Therefore, operability and workability deteriorate.

The read display data and sewing data for the pattern selected by mistake are stored in a data memory, such as a RAM, of the controller in the sewing machine. In this case, unnecessary data remain in the data memory. To make the best use of the data memory, an operation to clear the data therein is necessary. When the pattern has been selected by mistake, the operability and the workability again deteriorate.

SUMMARY OF THE INVENTION

The invention provides an embroidery data reading apparatus for a sewing machine capable of increasing the operability and the workability when the pattern has been selected by mistake, and to immediately cope with the pattern selected by mistake. Although the invention will be discussed in the context of embroidery sewing, because such is data intensive, it is applicable to any type of structured pattern sewing, such as buttonholes, pocket placement and similar structured pattern sewing routines.

In this regard, an embroidery, or pattern, data reading apparatus for a sewing machine of the embodiment of the invention may include a memory for rewritably storing embroidery, or pattern, data, the embroidery data including at least sewing data that defines stitches for forming an embroidery, or structured, pattern, a reading device that reads the embroidery data from outside of the apparatus and writes the embroidery data into the memory, and a cancel device that cancels the reading of the embroidery data during the reading of the embroidery data.

According to the embroidery data reading apparatus structured as described above, a reading device reads the embroidery data from outside of the apparatus and writes the embroidery data into the memory, and a cancel device cancels the reading of the embroidery data during the reading of the embroidery data. Therefore, even if the reading of the embroidery data is mistakenly started, the reading process can be canceled when an operator notices the mistake. Thus, as the operator does not need to wait until the reading is completed, the operability and workability can be greatly improved.

In a preferred aspect of the invention, the embroidery data reading apparatus may further include a display that displays the embroidery pattern thereon, and a selection device that selects the embroidery pattern displayed on the display, and the reading device may read the embroidery data corresponding to the embroidery pattern selected by the selection device.

Therefore, even if a wrong embroidery pattern in selected, the reading of the embroidery data can be canceled during the reading when the operator notices the mistake. Thus, as the operator does not need to wait until the reading of the wrong embroidery data is completed, operability and workability can be greatly improved.

In a preferred aspect of the invention, the embroidery data may further include pattern display data to be used for displaying the embroidery pattern on the display. Further, the reading device may read the pattern display data and the sewing data in order and the cancel device cancels the reading of the embroidery data during the reading of the pattern display data. Therefore, even while the pattern display data is being read, the reading can be canceled immediately when the operator notices the mistake in selecting the pattern, in other words, before the reading of the sewing data that takes a long time is started.

In a preferred aspect of the invention, the cancel device may further cancel the reading of the embroidery data between the completion of the reading of the pattern display data and the start of the reading of the sewing data. Therefore, when the operator notices the mistake in selection of the pattern between the completion of the reading of the pattern display data and the start of the reading of the sewing data, the operator can cancel the reading of the sewing data before the reading of the sewing data in started.

In a preferred aspect of the invention, the cancel device may further cancel the reading of the embroidery data during the reading of the sewing data. Therefore, even after the operator notices the mistake in selection of the pattern, the operator can cancel the reading of the sewing data.

In a preferred aspect of the invention, the display may include a touch key panel having at least a touch key thereon and the touch key panel may include a cancel instruction touch key that instructs the cancellation of the reading of the embroidery data. Further, the touch key panel may further include a determination touch key that instructs the execution of the reading of the embroidery data. Therefore, the operator can instruct cancellation of the reading of the embroidery data using the cancel instruction touch key in an easy manner. In addition, the operator can instruct execution of the reading of the embroidery data using the determination touch key in an easy manner.

In a preferred aspect of the invention, the reading device may read the embroidery data from an external storage device which is provided outside of the apparatus. Further, the external storage device may include a magnetic storage device or an optical storage device. Therefore, as such mechanical storage devices take a longer time to complete the reading of the embroidery data, compared to semiconductor memory, there is a great advantage in eliminating the waste of time by canceling the reading.

In a preferred aspect of the invention, the reading device may read the embroidery data through a communication device. Therefore, the embroidery data can be read from a network, such as the Internet, through a communication device.

In a preferred aspect of the invention, the display may display a name of the embroidery pattern, and the cancel device may cancel the reading of the embroidery data while the name of the embroidery pattern is displayed. Therefore, the operator can confirm the name of the embroidery pattern on the display and then cancel the reading when the operator notices a mistake in the selection of the pattern.

In a preferred aspect of the invention, the display may display an image of the embroidery pattern, and the cancel device may cancel the reading of the embroidery data while the image of the embroidery pattern is displayed. Therefore, the operator can confirm the image of the embroidery pattern on the display and then cancel the reading when the operator notices a mistake in the selection of the pattern.

BRIEF DESCRIPTION OF THE DRAWINGS

The invention will be described in greater detail with reference to preferred embodiments thereof and the accompanying drawings wherein.

DESCRIPTION OF THE PREFERRED EMBODIMENTS

A preferred embodiment of the invention will be described in detail with reference to the accompanying drawings.

The invention will be described embodied in an electronically-controlled sewing machine having a detachable embroidery frame driving device (embroidery device) that enables both utility stitch sewing and the embroidery of various patterns.

Figure 1:
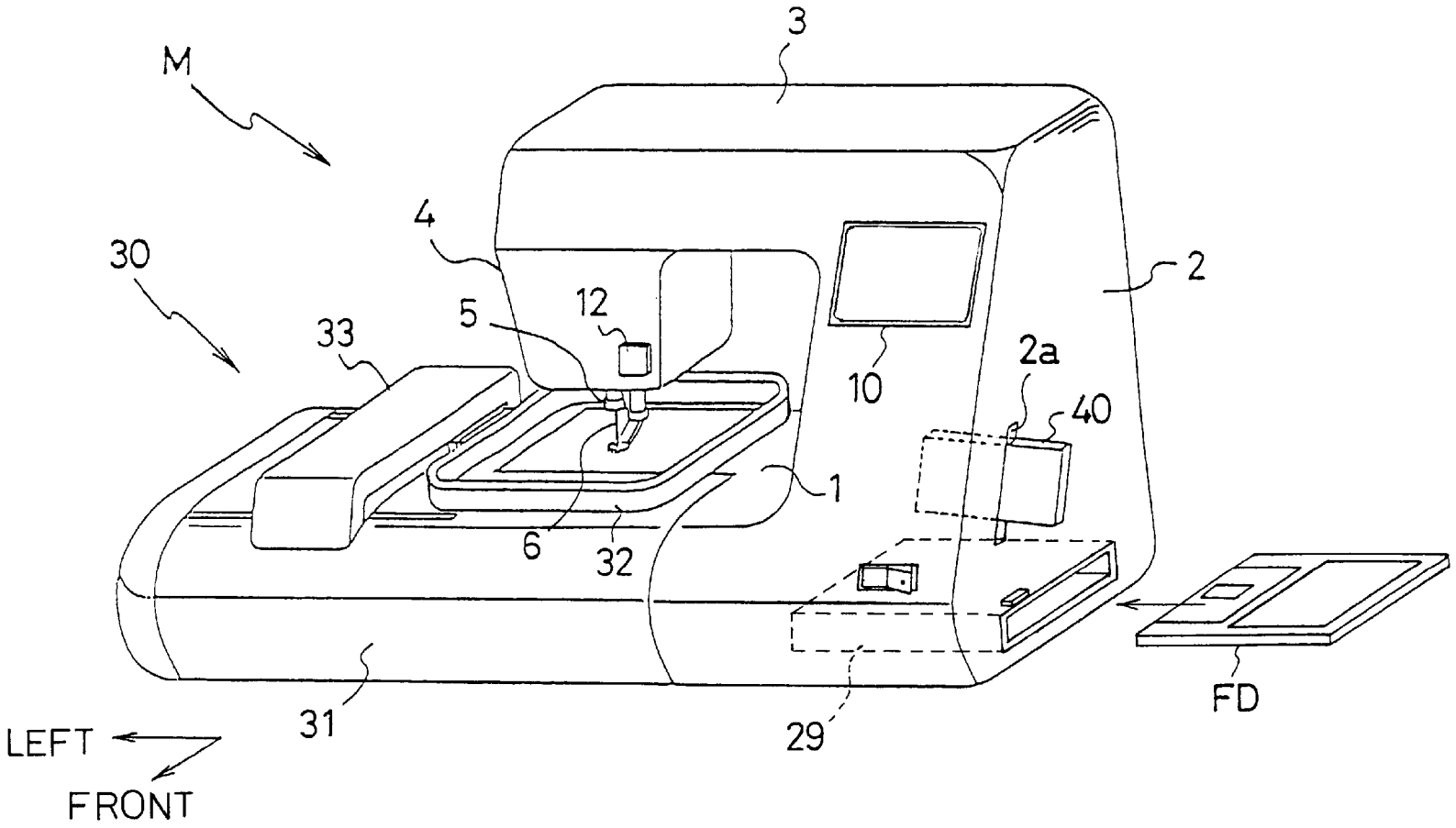
FIG. 1 is a perspective view of an electronicallycontrolled sewing machine according to an embodiment of the invention.

As shown in FIG. 1, an electronically-controlled sewing machine M has a bed 1, a standard portion 2 that stands on the right of the bed 1, and an arm 3 extending from the upper part of the standard portion 2 parallel to and facing the bed 1.

The bed 1 includes a feed dog (not shown), a feed dog up and down moving mechanism (not shown) that moves the feed dog up and down, a feed dog back and forth moving mechanism (not shown) that moves the feed dog back and forth, and a thread loop taker (e.g., a vertical axis oscillating shuttle) that contains a bobbin and cooperates with a needle 6. On the side of the standard portion 2, there is a slot 2*a* in which a ROM card 40 to connected to an internal card connector 13 (refer to FIG. 2). The optional ROM card 40 has a large amount of embroidery pattern data (sewing data and display data) that can be used. A floppy disk drive (FDD) 29 is provided, in the side of the standard portion 2 under the slot 2*a*, in which a floppy disk (FD) can be inserted.

The arm 3 includes a needle bar driving mechanism (not shown) that moves a needle bar 5, having the needle 6 at the bottom, up and down, a needle bar swinging mechanism (not shown) that swings the needle bar 5 in the direction perpendicular to a feed direction of a work cloth, and a thread take-up driving mechanism (not shown) that moves a thread take-up in accordance with the up and down movement of the needle bar 5. The feed dog moving up and down mechanism, the needle bar driving mechanism, and the thread take-up driving mechanism are driven by a machine motor 17. The needle bar swinging mechanism in driven by a stepping motor 18 for swinging the needle bar. The feed dog back and forth driving mechanism is driven by a stepping motor 19 for moving the feed dog back and forth (refer to FIG. 2). A start/stop button 12 for a start/stop switch 12*a* to start and stop the sewing operation is provided on the front of a head 4 of the arm 3.

On the front of the standard portion 2, a large-sized color crystal liquid display (LCD) 10 is provided. The LCD 10 displays utility stitch patterns, embroidery patterns, pattern names, and various information. The LCD 10 has a plurality of touch keys 11 that are transparent electrodes placed in a matrix thereon. The touch keys 11 can be programmed to a plurality of embroidery patterns, embroidery pattern names, and function names. Selection of a desired embroidery pattern or an order of a function can be realized simply by pressing a so-programmed corresponding touch key 11.

A free bed, generally known as a free arm, is formed on the left end of the bed 1. The embroidery frame driving device 30 is detachably fixed thereto. The embroidery frame driving device 30 includes a casing 31, an embroidery frame, or work holder, 32 that detachably holds a work cloth, a Y direction moving member 33 having a built-in Y direction driving mechanism that moves the embroidery frame 32 in the Y direction (backward and forward), and an X direction driving mechanism, included in the casing 31, that moves the Y direction moving member 333in the X direction (leftward and rightward). The X direction driving mechanism is driven by a first stepping motor 34, and the Y direction driving mechanism is driven by a second stepping motor 35 (FIG. 2).

When the embroidery frame driving device 30 is attached to the free bed, the first and second stepping motors 34, 35 are electronically connected to a controller C of the sewing machine M via a connector 14. The controller C controls and drives the motors 34, 35, to move the embroidery frame 32, in which a work cloth is set, in the X- and Y-axis directions individually to perform an embroidering operation.

A control system of the sewing machine M will now be described.

Figure 2:
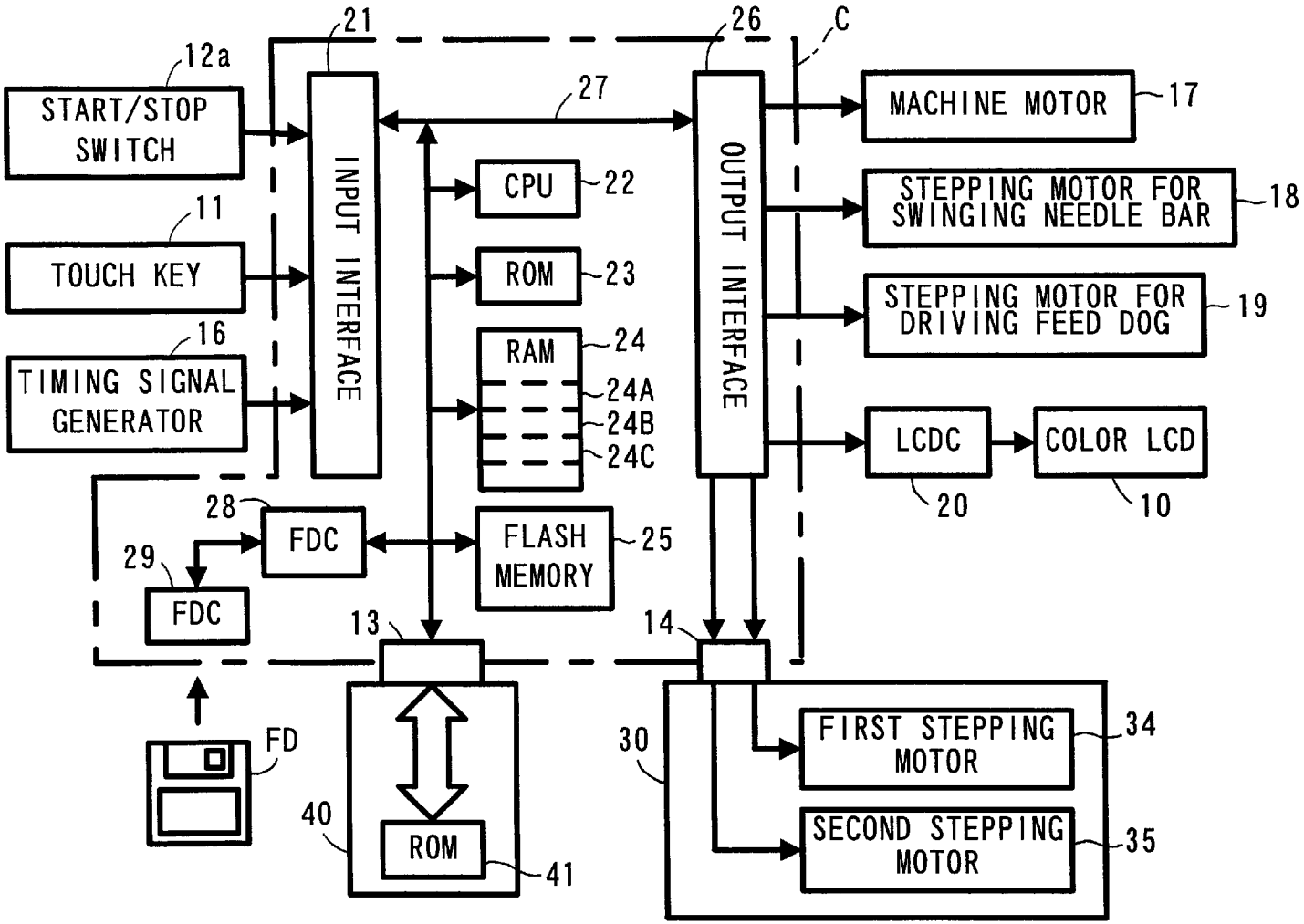
FIG. 2 is a control block diagram of the electronically-controlled sewing machine.

As shown in FIG. 2, the controller C has an input interface 21, a CPU 22, a ROM 23, a ROM 24, a nonvolatile flash memory 25 that is electronically rewritable, an output interface 26, and a floppy disk controller (FDC) 28 that drives the FDD 29, which are all connected via a bus 27, such as data bus. The input interface 21 is connected to the start/stop switch 12*a*, the touch keys 11, and a timing signal generator 16 that detects a plurality of rotating phases of the sewing machine main shaft.

The output interface 26 is connected to the motors 17, 18, 19, and a display controller (LCDC) 20 for the LCD 10. The first and second stepping motors 34, 35 are connected to the output interface 26 via the connector 14.

A ROM 41 of the ROM card 40 is connected to the bus 27 via the connector 13. The FDC 28 is also connected to the bus 27.

The ROM 23 prestores basic programs related to a sewing control and a display control both required to sew a utility stitch pattern, an editing control program for editing a selected embroidery pattern by enlargement, reduction, and/or rotation via the LCD 10, an embroidering program for sewing a selected embroidery pattern, a data reading control program for reading each sector of the data stored in the FD, and a pattern selection control program that will be described later.

Further, the ROM 23 prestores instruction display font data for alphabet in 10 pt (approx. 3.6 mm), 15 pt (approx. 5.4 mm), and 27 pt (approx. 10 mm) to indicate associated information data, such as a pattern name, the number of stitches, and the number of colors. All font data are associated with alphabet code data.

Figure 3:
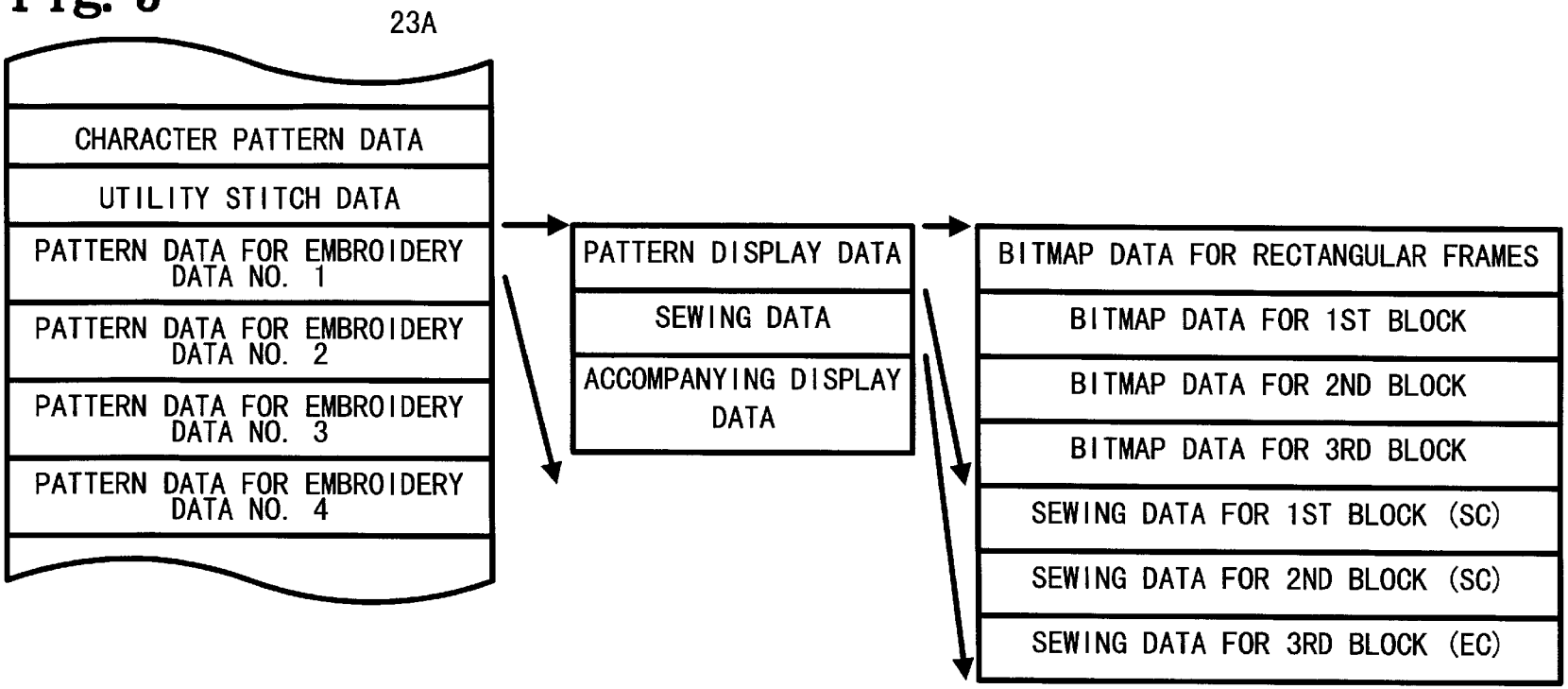
FIG. 3 shows a data structure in a pattern data memory.

The pattern data memory 23*a* of the ROM 23 stores, as shown in FIG. 3, the following data types: a set of character pattern data for character patterns related to letters, symbols and numerals, which comprise display data and sewing data; utility stitch pattern data for utility stitch patterns including straight and zigzag stitches, which comprise display data and sewing data, and embroidery pattern data for embroidery patterns which are relatively frequently used and divided into groups designated with numbers (like embroidery pattern No. 1, embroidery pattern No. 2, embroidery pattern No. 3).

Figure 10:
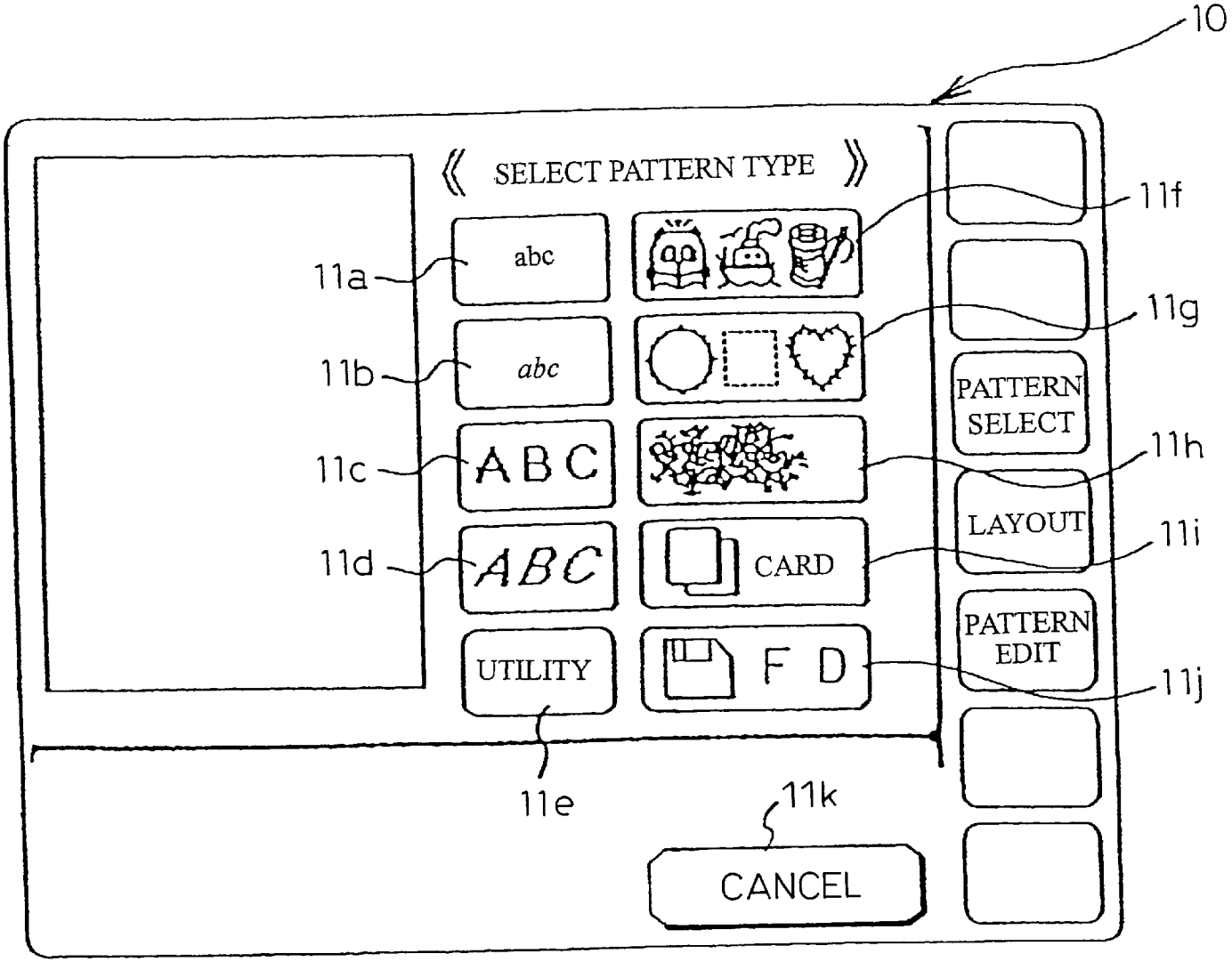
FIG. 10 is an example of a menu screen in which a pattern type is selected.
Figure 14:
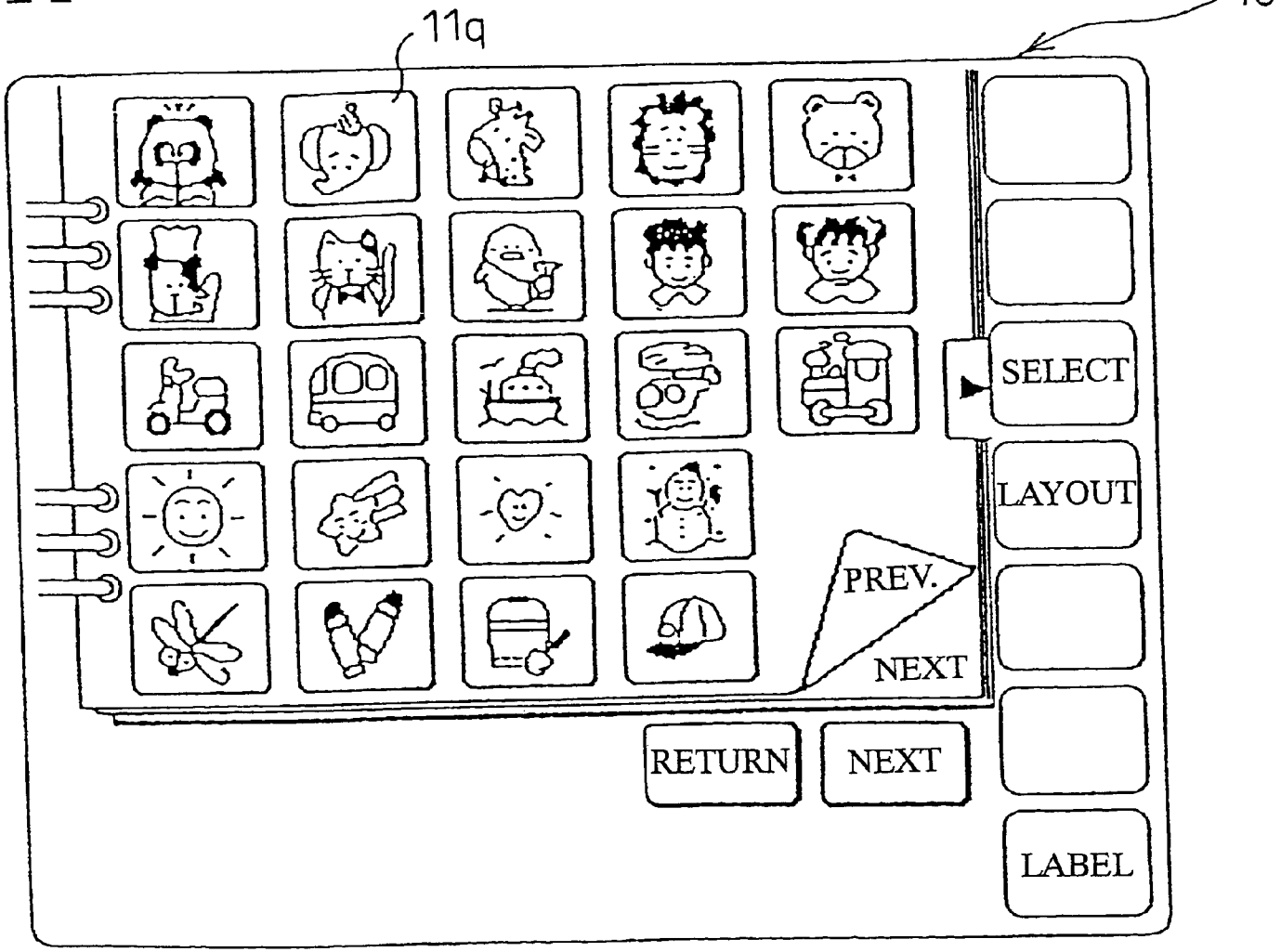
FIG. 14 is an example of a screen showing a list of a set of embroidery patterns.
Figure 15:
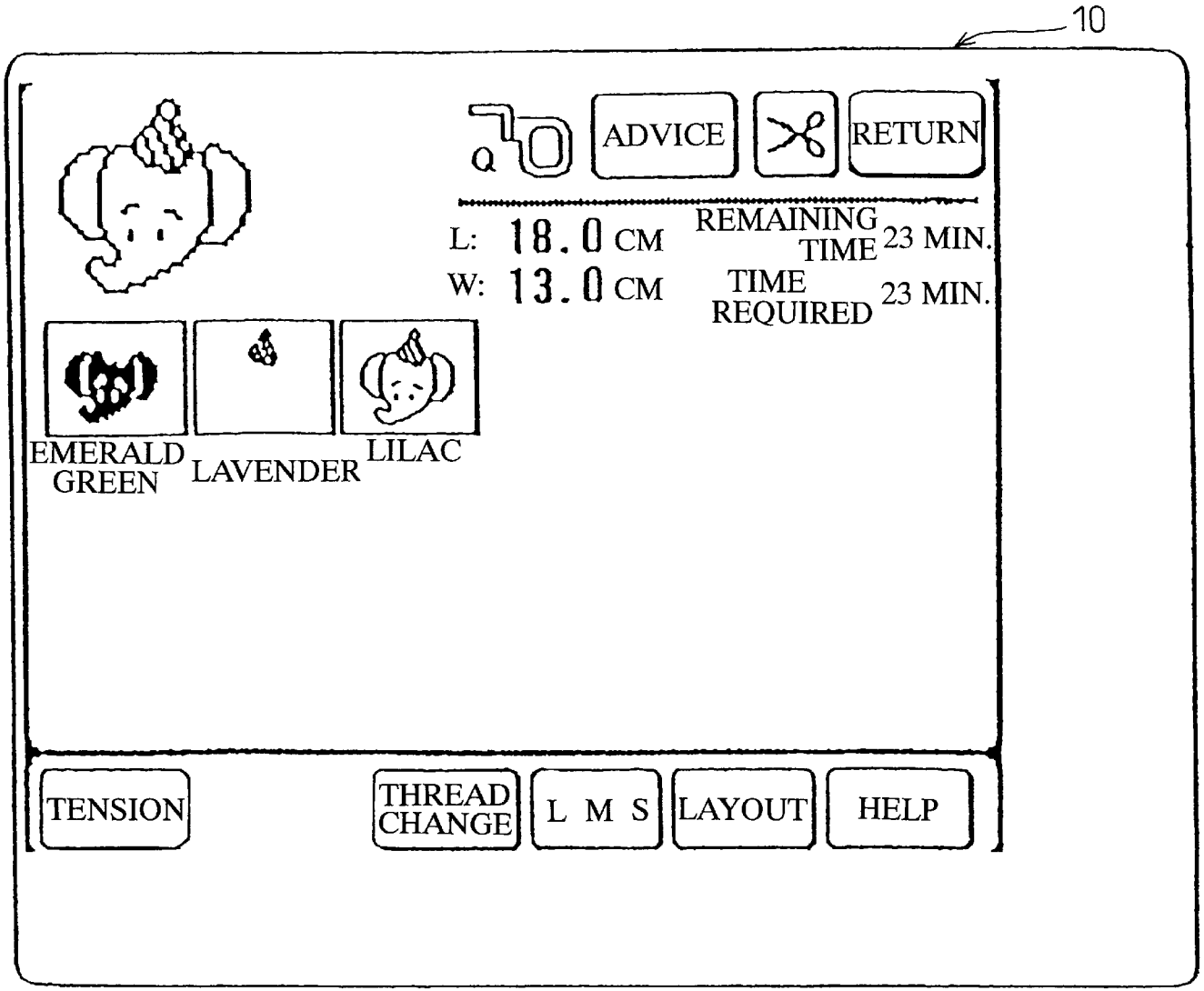
FIG. 15 is an example of a screen that displays a selected pattern and its constituent blocks.

As embroidery pattern data have the same structure or format, the embroidery pattern data for embroidery pattern No. 1 is taken as an example. As shown in FIG. 3, the data for embroidery pattern No. 1 comprises display data, sewing data, and accompanying display data. The display data is used to display the entire pattern and its constituent blocks to be embroidered with different colors; the sewing data includes one of stitch position data for each stitch of each block of the pattern or outline data and thread density data to calculate stitch position data for each block of the pattern required in order to perform embroidering; and the accompanying display data in used to display related information on a screen for pattern selection, as shown in FIGS. 10 and 14, and on a screen shown during the sewing operation, as shown in FIG. 15. All data is stored distinctively.

For example, an "elephant," as shown in FIG. 15, which is embroidered with three different colors, to set as embroidery pattern No. 1. The elephant pattern comprises first, second, and third blocks. To display the blocks surrounded by rectangular frames on the LCD 10, bitmap data for each of the blocks and the rectangular frames are stored as the display data of the elephant pattern. As sewing data, the elephant pattern has a set of sewing data for each of the three blocks, the block data can either be stitch position data or calculated stitch position data on the basis of the outline data and thread density data, for each of which is sewn with one of the three different colors. The sewing data for each block includes a stop code (SC), for thread change, the thread density and a sewing time. The sewing data for the last block includes an end code (EC) instead of a SC. As accompanying display data, the elephant pattern includes the display data to display massages and function names related to the screens.

A plurality of ROM cards 40 are available containing various kinds of patterns for sewing on the sewing machine M. Data for a plurality of embroidery patterns, which are rarely used, are stored in the ROM 41 of each ROM card 40 with the same structure as used in the ROM 23. The data for the embroidery patterns are categorized into groups according to types and numbered (e.g. embroidery pattern no. 1, embroidery pattern no. 2, and embroidery pattern no. 3) (FIG. 3). The FD is also available for storing pattern data in addition to or in place of the ROM card 40.

The RAM 24 includes a pattern name memory 24*a* that stores pattern name data for a plurality of pattern names and associated information data, which are both read from the FD. A display data memory 24*b* stores display data for an embroidery pattern selected by a pattern name. A sewing data memory 24*c* stores sewing data for the embroidery pattern selected using the pattern name. The RAM 24 further includes various memories required for each control described above (e.g., flag memory, pointer memory, counter memory, register, buffer). The memories 24*a* to 24*c* correspond to a storage memory.

Figure 4:
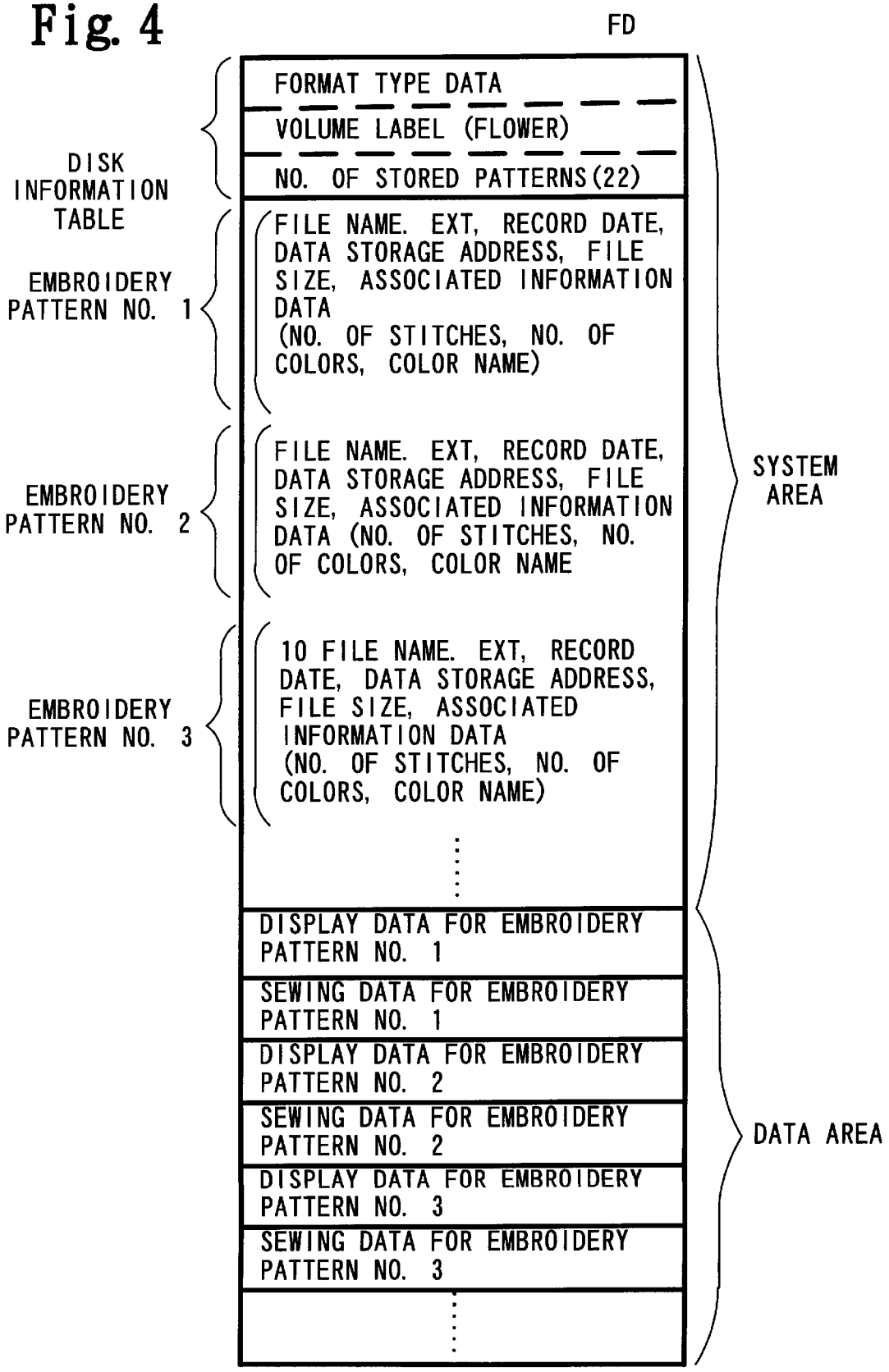
FIG. 4 shows a structure of data stored in a floppy disk.
Figure 5:
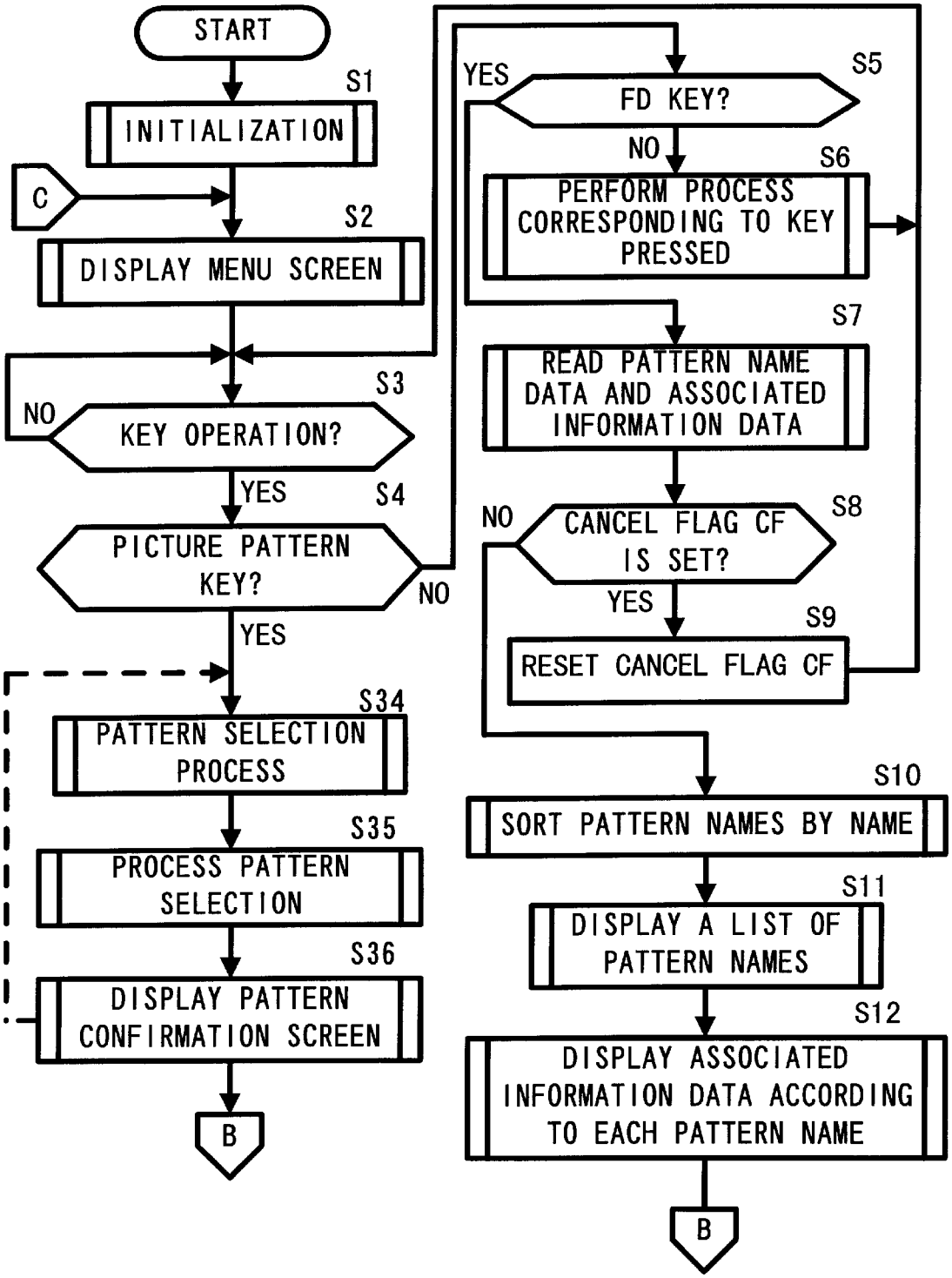
FIG. 5 is a flowchart of a main routine of a pattern selection control.
Figure 6:
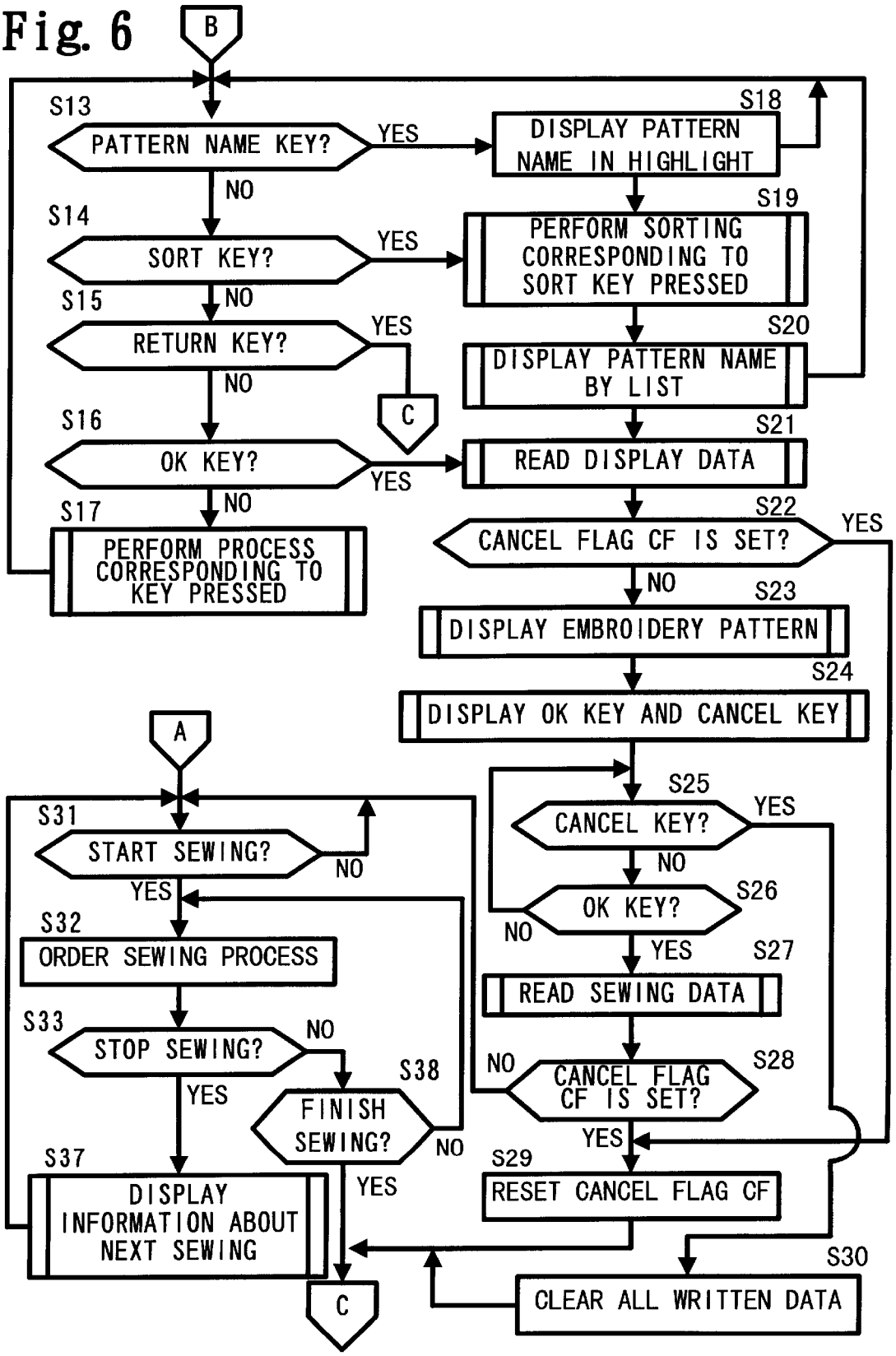
FIG. 6 is a flowchart of a subroutine of the pattern selection control.

As shown in FIG. 4, the FD for storing embroidery patterns includes various data in addition to the display data and the sewing data required for embroidery patterns. The FD can be divided into two areas, a system area and a data area.

A disk information table and a plurality of embroidery data look-up tables are stored in the system area. The disk information table includes format type data that defines the FD format, such as 2DD or 2HD, a volume label, e.g. "FLOWER," and the number of patterns stored, e.g. "22." In addition, each embroidery data look-up table includes a filename having a pattern name and an extension, a recording date, an address for display data and sewing data stored in the data area, a file size, and associated information data related to stitch formation. An extension like ".HUS" is attached to the end of a filename to indicate the type of file.

The associated information data has information about the number of stitches to be sewn, the number of colors to be used, and color names for corresponding colors.

On the other hand, the data area includes display data and sewing data required to form each embroidery pattern in order of address indicated in the system area. If the sewing data is used to embroider a pattern with a plurality of colors, it includes stop codes that stop the needle for every thread (color) change.

Next is an explanation about routines regarding the pattern selection control executed in the controller C with reference to the flowcharts of FIGS. 5 to 9. In the flowcharts, S1 (i=1, 2, 3, . . . ) stands for a procedure step.

When the power is turned on and control is started, initialization, such as clearing each memory in the RAM 24, is performed (S1). Then a menu screen, in which a pattern type is selected, is displayed on the LCD 10 (S2).

For example, as shown in FIG. 10, the menu screen includes character specification keys 11*a* to 11*d* used for specifying a character pattern type, a utility stitch key 11 a for specifying a utility stitch pattern, picture pattern keys 11*f* to 11*h* for selecting a picture pattern, a card key Ii for selecting an embroidery pattern stored in the ROM card 40 inserted into the sewing machine M, an FD key 11*j* for selecting an embroidery pattern stored in the FD inserted into the sewing machine M. The keys 11*a* to 11*j* are operated as touch keys working together with text and patterns displayed on the screen.

Figure 7:
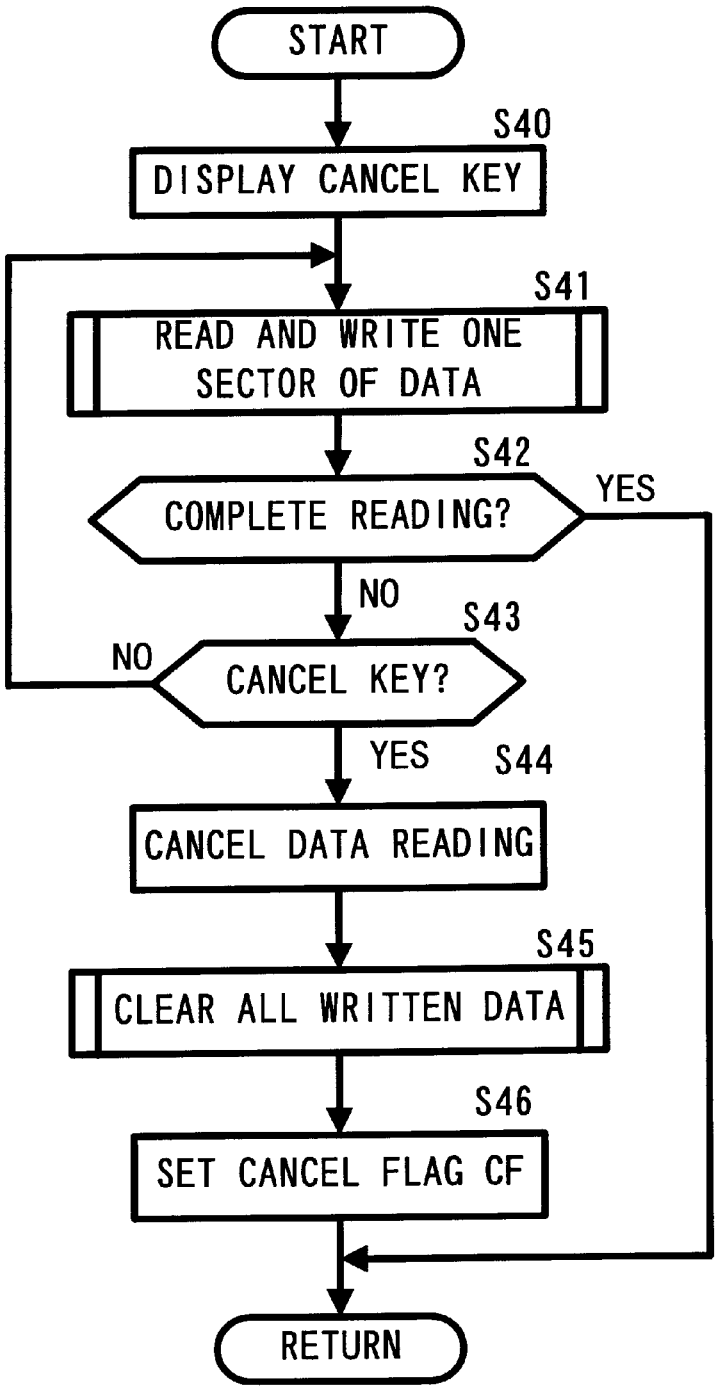
FIG. 7 is a flowchart of a pattern name data and associated information data reading control.
Figure 8:
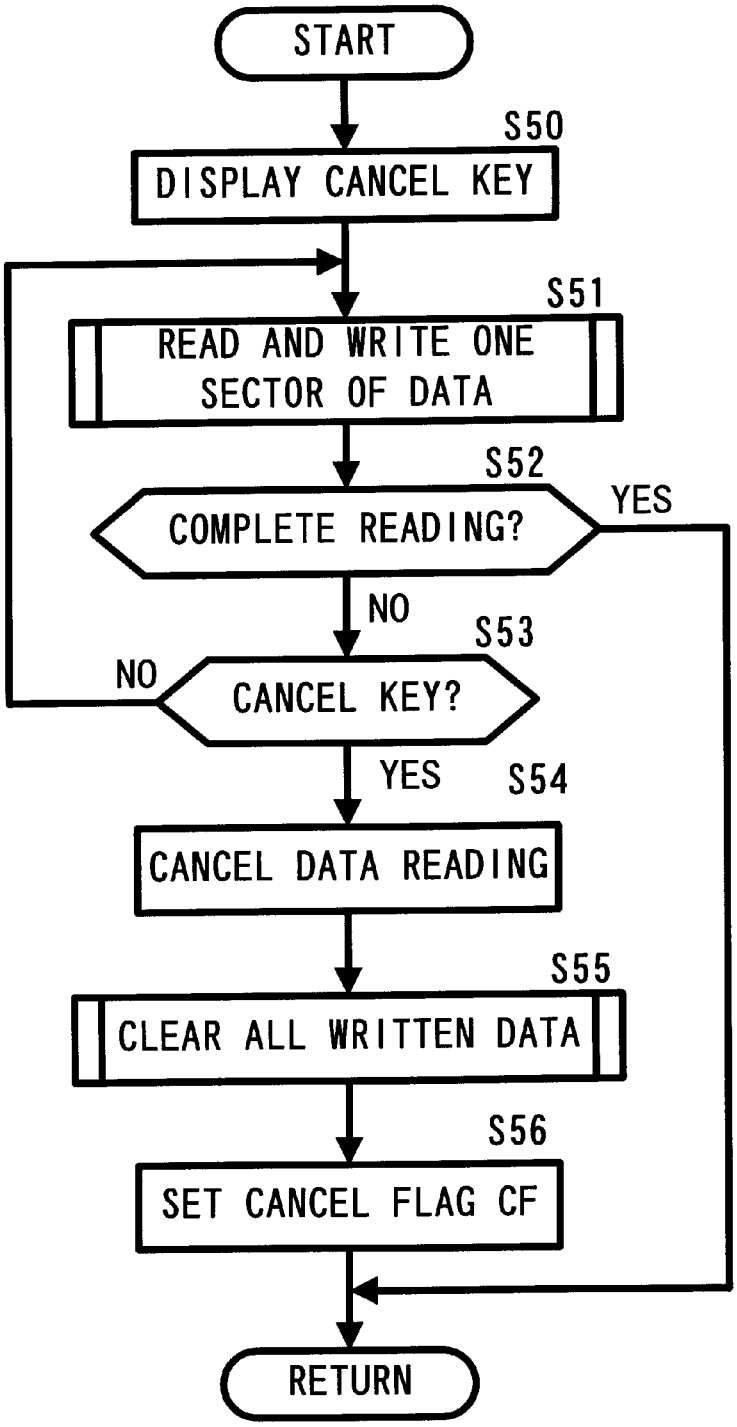
FIG. 8 to a flowchart of a display data reading control.
Figure 9:
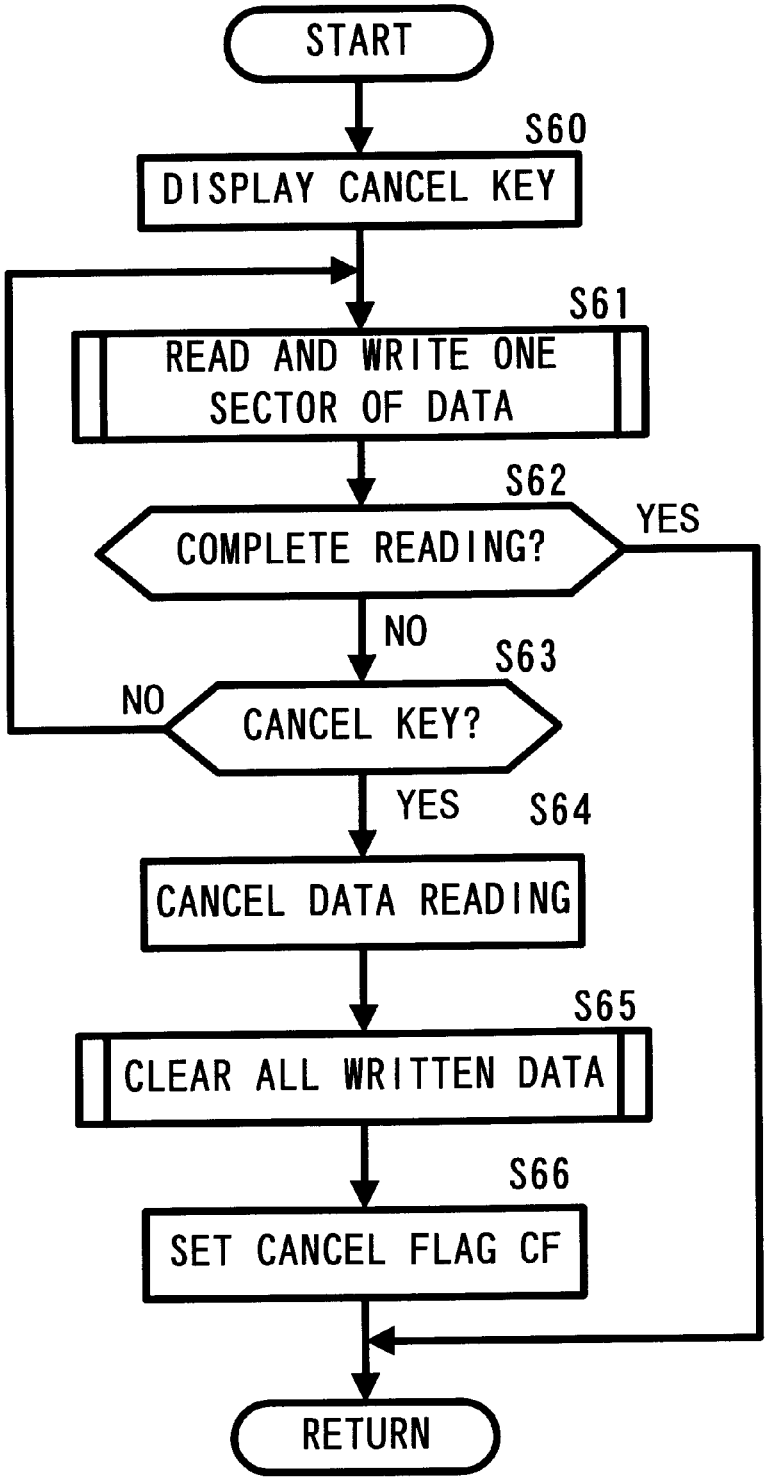
FIG. 9 is a flowchart of a sewing data reading control.

To select an embroidery pattern stored in the FD inserted in the FDD 29, the FD key 11*j* is pressed (S3: Yes, S4: No, S5: Yes). Then, the data reading process in which the pattern names and their associated information data are read from the FD, is executed (S7) (FIG. 7).

When the data reading process to started, the CANCEL key 11*k*, which is used to cancel the data reading process, is displayed at a predetermined place (S40). For example, as shown in FIG. 10, the CANCEL key 11*k*, a touch key, is displayed on the lower part of the menu screen.

The pattern name data and the associated information data are stored over a plurality of sectors, each sector having the predetermined number of bytes (e.g. 256 bytes), in the FD. In the data reading control program, one sector of data is read from the FD and written into the pattern name memory 24*a* (S41). If the data reading is not completed (S42: No) and the CANCEL key 11*k* is not pressed (S43: No), steps S41 to S43 are repeatedly performed, to read each sector of the pattern name data and the associated information data and write them into the pattern name memory 24*a*. If the data reading is completed without the CANCEL key 11*k* being pressed (S42: Yes), flow finishes the control and returns to S8 of the pattern selection control.

However, when the CANCEL key 11*k* is pressed during the data reading (S43: Yes), the data reading is canceled one of the data reading control program (S44). All data written into the pattern name memory 24*a* are cleared (by one of deleting the address directory, writing over the data with blank data, or reformatting the memory) (S45), the cancel flag CF is set (S46), and flow finishes the control and returns to S8 of the pattern selection control. If the cancel flag CF is set in the pattern selection control (S8: Yes), it is reset (S9) and the steps on and after step S3 are repeatedly performed.

If the cancel flag CF is not set, that is, if the data reading is not canceled (S8: No), the pattern names stored in this pattern name memory 24*a* are sorted alphabetically, and the sorted pattern names are renewedly stored in the pattern name memory 24*a* of the RAM 24 (S10). The LCD 10 displays a list of the sorted pattern names (S11), and the associated information data according to each of the pattern names (S12).

Figure 11:
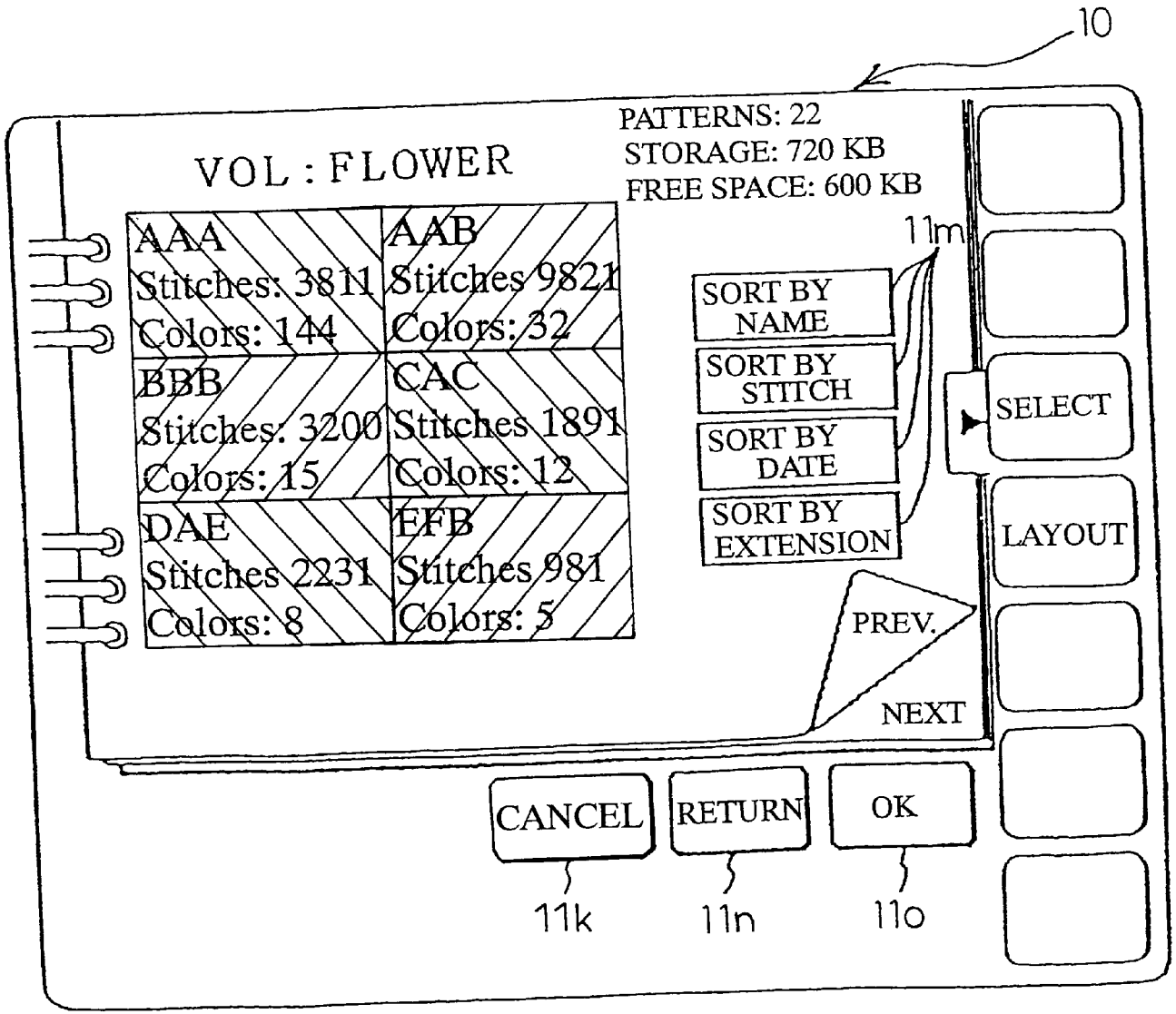
FIG. 11 is an example of a pattern name display screen.

For example, as shown in FIG. 11, the LCD 10 shows the pattern names, which are sorted alphabetically, from the top of the patterns stored in the FD, like AAA, AAB, BBB, in tabular form having the two columns with 15 pt screen fonts. Under each pattern name, the number of stitches and the number of colors are indicated. In addition, sort keys 11*m* for sorting the pattern names in order of the alphabet, the number of stitches, date of pattern extension, RETURN and OK keys are displayed. The pattern names that are in the hatched areas where lines are slanted to the right, such as AAA, CAC, DEA are covered with one color, such as blue, and the pattern names that are in the hatched areas where lines are slanted to the left are covered with another color such as green. The pattern names in all blocks AAA to EFB function as pattern name keys.

Figure 12:
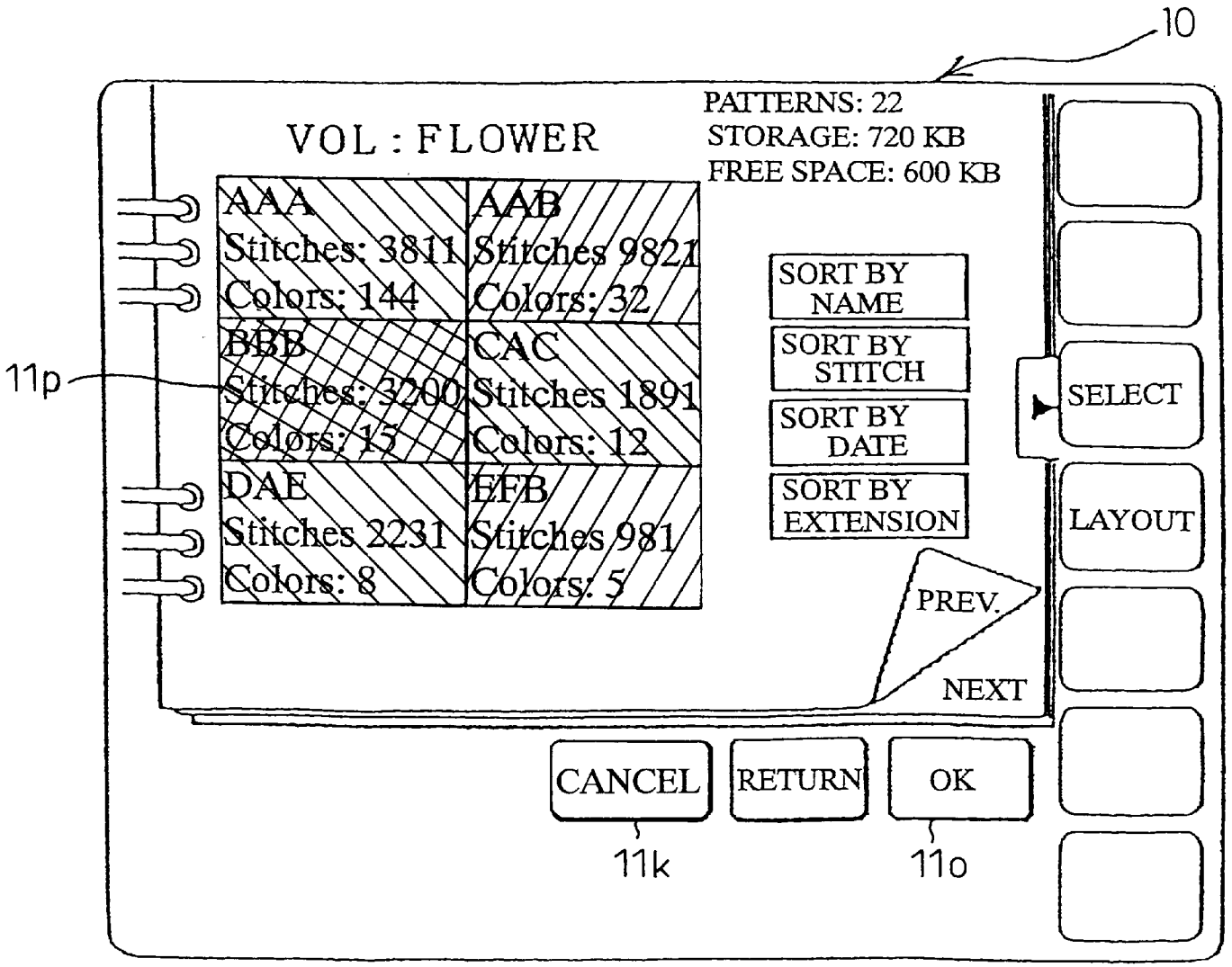
FIG. 12 corresponds to FIG. 11 when a pattern name in selected.

When a pattern name key representing a desired pattern name is pressed (S13: Yes), the pattern name corresponding to the key pressed is highlighted for identification (S18). For example, as shown in FIG. 12, when the pattern name key 11*p* is pressed, the corresponding pattern name "BBB" is selected and indicated in highlight on a colored background. Instead, the pattern name whose key is pressed may be indicated with a vivid color like red or displayed so that it blinks.

When a sort key 11*m* such as "sort by name" key and "sort by the number of stitches" key is pressed S13: No, S14: Yes), the sorting corresponding to the sort key pressed is performed (S19). The pattern names are sorted and redisplayed on the LCD 10 in tabular form (S20). When the RETURN key 11*n* is pressed (S13, S14: No, S15: Yes), steps on and after S2 are executed.

When the OK key 11*o* is pressed (S13 to S15: No. S16: Yes), the pattern selection for the pattern name highlighted for identification is fixed, and the data reading control (FIG. 8), in which its display data is read from the ED, is executed (S21).

The display data reading control will now be simply described as it is substantially the same as the pattern data and associated information data reading control described above.

When flow goes into this control, the CANCEL key 11*k* (FIG. 12) is displayed at a predetermined position (S50).

One sector of the display data is read from the FD and written into the display data memory 24*b* (S51). When the data reading is not completed (S52: No) and the CANCEL key 11*k* is not pressed (S53: No), steps S51 to S53 are repeatedly performed. When the display data reading is completed (S52: Yes), flow finishes the control and returns to stop S22 of the pattern selection control.

However, if the operator notices the wrong pattern has been selected in the middle of reading the display data and presses the CANCEL key 11*k* (S53: Yes), the display data reading is immediately canceled (S54), and all data written in the display data memory 24*b* are cleared (S55). Then the cancel flag CF is set (S56), and flow finishes the control and returns to step S22. When the cancel flag CF is set in the pattern selection control (S22: Yes), it is reset (829), and steps on and after step S2 are repeatedly performed. Therefore, even in the middle of reading the display data, the reading can be canceled immediately when the operator notices that the pattern has been selected by mistake. In other words, the data reading can be canceled before the sewing data that requires a large amount of time to read. The cancellation copes with the mistake immediately and improves the operability and the workability of the machine when the pattern has been selected by mistake.

Figure 13:
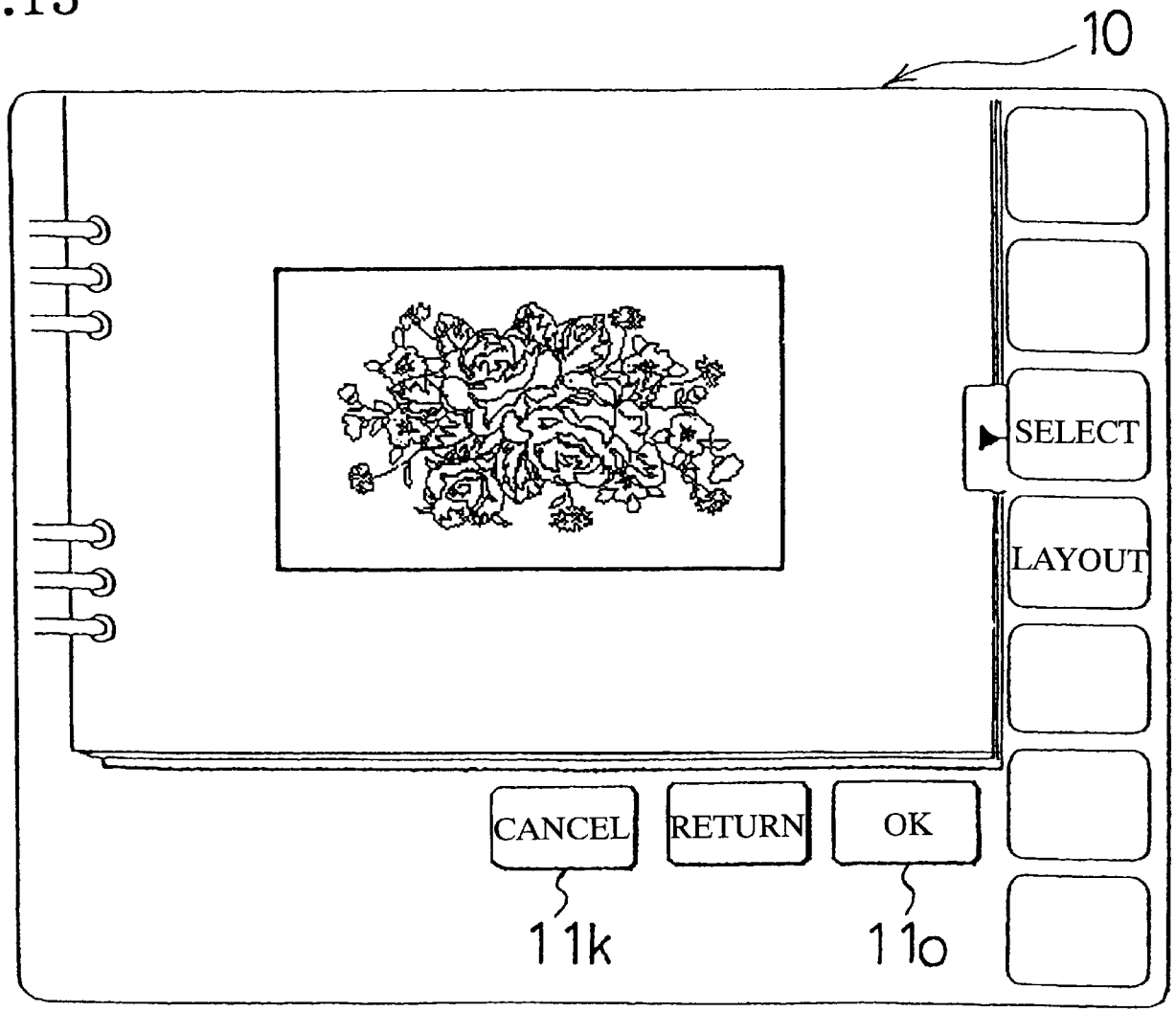
FIG. 13 is an example of an embroidery pattern selected with the pattern name.

On the other hand, when the cancel flag CF is not set, in short, when the display data reading is completed (S22: No), the embroidery pattern is displayed based on the display data written into the display data memory 24*b* instead of the pattern names in tabular form (S23). For example, FIG. 13 shows the floral pattern registered under the embroidery name "BBB," which is selected by the pattern name key 11*p* in FIG. 12. Then in preparation for reading the sewing data of the displayed embroidery pattern, the CANCEL key 11*k*, which is used to cancel the sewing data reading process, and the OK key 11*o*, which is used to execute the reading, are displayed (S24). As shown in FIG. 13, the CANCEL key 11*k* and the OK key 11*o* appear on the lower part of the screen.

When the displayed pattern is not the desired one and the CANCEL key 11*k* is pressed (S25: Yes), the reading of its sewing data is canceled. Thus, all display data written into the display data memory 24*b* are cleared (S30), and the steps on and after step S2 are repeatedly performed. Therefore, the reading of the sewing data for the pattern selected by mistake can be canceled before it starts. The cancellation copes with the mistake immediately and improves the operability and the workability when the pattern has been selected by mistake.

On the other hand, when the displayed pattern is the desired one and the OK key 11*o* is pressed (S26: Yes), the reading process (FIG. 9), in which the sewing data of the pattern is read from the FD, is executed (S27).

The sewing data reading control will now be simply described as it is substantially the same as the display data reading control described above.

When flow goes into this control, the CANCEL key 11*k* (FIG. 13) is displayed at a predetermined position (S60).

One sector of the sewing data is read from the FD and written into the sewing data memory 24*c* (S61). When the data reading is not completed (S62: No) and the CANCEL key 11*k* is not pressed (S63: No), steps S61 to S63 are repeatedly performed. When the sewing data reading is completed (S62: Yes), flow finishes the control and returns to step S28 of the pattern selection control.

However, if the operator notices the wrong pattern has been selected in the middle of reading the sewing data and then presses the CANCEL key 11*k* (S63: Yes), the sewing data reading is immediately canceled (S64), and all data written in the sewing data memory 24*c* and the display data memory 24*b* are cleared (S65). Then the cancel flag CF is set (S66), and flow finishes the control and returns to step S28. When the cancel flag CF is set in the pattern selection control (S28: Yes), it is reset (S29), and steps on and after step S2 are repeatedly performed.

In other words, after the display data is read, the pattern appears on the screen so that the operator can see if the displayed pattern is the desired one. As a result, if the displayed pattern is not the desired one, the operator can cancel the reading of the sewing data immediately before the reading is completed. The cancellation copes with the mistake immediately and improves the operability and the workability when the wrong pattern has been selected. Furthermore, there is no need to read all the sewing data for the pattern selected by mistake, which can eliminate time taken for the useless reading and greatly improve the work efficiency.

On the other hand, when the cancel flag CF is not set, in short, when the sewing data reading is completed (S28: No), flow is on standby until the saving starts (S31: No). When the start/stop switch 12*a* is activated to start the sewing process (S31: Yes), the order of the sewing process is issued (S32). As a result, the sewing data for each stitch are read from the saving data memory 24*c* in the sewing control, and the sewing process is performed (S32, S33: No, S38: NO).

If the sewing is temporarily suspended halfway because of stop code SC for a thread change (S33: Yes), the LCD 10 displays the sewing information for the next color such as "second (third) color is to be embroidered" (S37). If a thread is broken or the sewing is suspended because of the operation of the start/stop key 12*a*, the sewing operation is just stopped temporarily.

When the sewing of all constituent blocks is completed (S33: No. S38: Yes), steps on and after S2 are repeatedly performed.

On the other hand, when the picture pattern key 11*f* (FIG. 10) is pressed on the menu screen (S3 and S4: Yes), the patterns, such as animals and flowers, are displayed in the matrix of rows and columns on the LCD 10 as shown in FIG. 14 (S34). If then, for example, the pattern key 11*q*, representing an elephant is pressed to select the elephant pattern (S35), the LCD 10 displays the pattern confirmation screen as shown in FIG. 15, in which the original pattern "elephant" and its constituent three blocks are displayed (S36). If the RETURN key is pressed on the pattern confirmation screen, flow returns to step S34.

As described above, flow executes steps S31 to S33. S37, and S38, and the elephant pattern is sewn with three colors. In this case, the next block, like the second or third block, is displayed shifted to the left on the screen at S37 whenever the sewing is suspended after the sewing of the current block is completed (S33: Yes).

The LCD 10, the LCDC 20, and the display control program correspond to a display device, the pattern selection control, especially steps S21 and S27, and the controller C correspond to a reading device or a data reading routine. The CANCEL key 11*k*, steps S50, S53 to S55, S60, S63 to S65, and the controller C correspond to a reading cancel device or reading cancel routine. The pattern selection control, especially step S23, and the controller C correspond to a pattern display control device or a pattern display control routine. The CANCEL key 11*k*, the saving data reading control, especially step S64 correspond to a cancel ordering device. The CANCEL key 11*k* corresponds to a cancel touch key. The OK key 11*o* corresponds to a determination touch key.

Thus, in the pattern selection control where a desired embroidery pattern is selected, when the pattern is selected from the FD, its display data and sewing data are read in order. Even while the display data is being read, the reading can be canceled immediately when the operator notices a mistake in selecting the pattern, in other words, before the reading of the sewing data that takes a long time is started. Even while the sewing data, to be read after the display data, is being read, the reading can be canceled an soon as the operator notices the mistake in selecting the embroidery pattern, in short, before the reading of the saving data which takes a long time is completed. The cancellation can improve the operability and the workability that would be degraded in the case where there was a mistake in selecting the embroidery pattern and all data had to be read. In addition, because the sewing data for the pattern selected by mistake is not to be read until the end, the time taken for the useless reading can be eliminated and the work efficiency greatly improves.

In the display data reading control, the selected embroidery pattern is displayed on the LCD 10 based on its display data stored in the display data memory 24*b*. Therefore, it allows the operator to confirm easily whether the selected pattern is the desired one through the display of the LCD 10.

When the CANCEL key 11*k* is pressed during the reading of the sewing data and then the reading is canceled, all data written into the sewing data memory 24*c* and the display data memory 24*b* are cleared. Therefore, the unnecessary display data and sewing data for an embroidery pattern selected by mistake do not remain in the memories 24*b*, 24*c*. Doing so improves the effective use of the memories 24*b*, 24*c*.

Furthermore, there is no need to do an operation specifically for data clearing, which also improves the operability and the workability when the pattern has been selected by mistake. Further in the pattern selection, when the LCD 10 shows an embroidery pattern selected by the pattern name, it also shows the CANCEL key 11*k* that orders the cancellation of the sewing data reading and the OK key 11*o* that orders the execution of reading. When the operator notices that the displayed pattern is not the desired one through the display of the LCD 10, the reading of the sewing data for the pattern wrongly selected can be canceled promptly before it is read. Therefore, the operability and the workability of the sewing machine is improved when a pattern is selected by mistake.

As the pattern selection control program provided in the ROM 23 can alternatively be stored in the FD, it can be used on a sewing machine with embroidery function and a floppy disk drive. In this case, the FD corresponds to a storage medium storing the pattern selection program of the invention. The storage medium may be another medium, such as a RAM card, a CD-ROM, a digital video disk (DVD), and a laser disk.

The cancel switch can also be provided on the front of the standard portion 2 and the arm 3.

The electronically-controlled sewing machine with embroidery function M can be connected to an external personal computer or the Internet. When the display data or the moving data are received via communication device from the personal computer or the Internet, the reading of the data can be canceled. In other words, it is possible to cancel the reception of the embroidery-related data, such as the display data and the sewing data.

The FDD 29 can be provided anywhere on the sewing machine M, in addition to the standard portion 2, or can be separated from the sewing machine M.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. A pattern data reading apparatus for a sewing machine, comprising:

a memory for rewritably storing pattern data, the pattern data including at least sewing data for a structured pattern;

a reading device that reads the pattern data from outside of the apparatus and writes the pattern data into the memory; and a cancel device that cancels the reading and writing of the pattern data during the reading of the pattern data.

2. The pattern data reading apparatus according to claim 1, wherein the sewing data comprises stitch position data that defines each stitch position included in each block making up a pattern.

3. The pattern data reading apparatus according to claim 1, wherein the sewing data comprises outline data and thread density data for each block making up the pattern.

4. The pattern data reading apparatus according to claim 1, further comprising:

a display that displays the structured pattern thereon; and a selection device that selects the structured pattern displayed on the display, wherein the reading device reads the pattern data corresponding to the structured pattern selected by the selection device.

5. The pattern data reading apparatus according to claim 4, wherein the pattern data further includes pattern display data to be used for displaying the structured pattern on the display.

6. The pattern data reading apparatus according to claim 5, wherein the reading device reads the pattern display data and the sewing data in order.

7. The pattern data reading apparatus according to claim 6, wherein the cancel device cancels the reading of the pattern data during the reading of the pattern display data.

8. The pattern data reading apparatus according to claim 6, wherein the cancel device cancels the reading of the pattern data between the completion of the reading of the pattern display data and the start of the reading of the sewing data.

9. The pattern data reading apparatus according to claim 6, wherein the cancel device cancels the reading of the pattern data during the reading of the sewing data.

10. The pattern data reading apparatus according to claim 7, wherein the cancel device cancels the reading of the pattern data between the completion of the reading of the pattern display data and the start of the reading of the sewing data.

11. The pattern data reading apparatus according to claim 10, wherein the cancel device cancels the reading of the pattern data during the reading of the sewing data.

12. The pattern data reading apparatus according to claim 7, wherein cancel device cancels the reading of the pattern data during the reading of the sewing data.

13. The pattern data reading apparatus according to claim 8, wherein the cancel device cancels the reading of the pattern data during the reading of the sewing data.

14. The pattern data reading apparatus according to claim 8, wherein the cancel device includes a cancel instruction device that instructs canceling the reading of the pattern data.

15. The pattern data reading apparatus according to claim 1, further comprises a delete device that deletes all of the pattern data written in the memory when the reading of the pattern data is canceled.

16. The pattern data reading apparatus according to claim 4, wherein the display comprises a touch key panel having at least one touch key thereon.

17. The pattern data reading apparatus according to claim 16, wherein the touch key panel includes a cancel instruction touch key that instructs canceling the reading of the pattern data.

18. The pattern data reading apparatus according to claim 17, wherein the touch key panel further includes a determination touch key that instructs execution of the reading of the pattern data.

19. The pattern data reading apparatus according to claim 1, wherein the reading device reads the pattern data from an external storage device which is provided outside of the apparatus.

20. The pattern data reading apparatus according to claim 19, wherein the external storage device comprises a magnetic storage device or an optical storage device.

21. The pattern data reading apparatus according to claim 1, wherein the reading device reads the pattern data through a communication device.

22. The pattern data reading apparatus according to claim 4, wherein the display displays a name of the structured pattern, and the cancel device cancels the reading of the pattern data while the name of the structured pattern is displayed.

23. The pattern data reading apparatus according to claim 4, wherein the display displays an image of the structured pattern, and the cancel device cancels the reading of the pattern data while the image of the structured pattern is displayed.

24. A method for canceling receipt and storage of pattern data by a sewing machine, comprising:

reading data from an external source;

writing the read data into a rewritable memory associated with the sewing machine; and canceling the reading of the data before completion.

25. The method according to claim 24, wherein the external source is one of a removable or detachable storage medium and through a communications line connected to a remote source.

26. The method according to claim 24, wherein the reading step comprises reading pattern display data and sewing data in order.

27. The method according to claim 26, the reading further comprising reading pattern name data available from the external source; and the method further comprising displaying name data on a display.

28. The method according to claim 27, further comprising at least one of sorting the displayed name data based on predetermined criteria and selecting a pattern for display.

29. The method according to claim 27, further comprising designating the displayed pattern for sewing.

30. The method according to claim 26, wherein canceling the reading of data can be executed when reading pattern display data, reading sewing data and between the preceding activities.

31. The method according to claim 27, wherein canceling the reading of data can be executed when reading pattern name data, reading pattern display data, reading sewing data and between the preceding activities.

32. A recording medium for storing programs for canceling receipt and storage of pattern data by a sewing machine, comprising:

a program for reading data from an external source;

a program for writing the read data into a rewritable memory associated with the sewing machine; and a program for canceling the reading of the data before completion.

33. The recording medium according to claim 32, wherein the external source is one of a removable or detachable storage medium and through a communications line is connected to a remote source.

34. The recording medium according to claim 32, wherein the program for reading reads pattern display data and sewing data in order.

35. The recording medium according to claim 34, wherein the program for reading reads pattern name data available from the external source, and further comprising a program for displaying name data on a display.

36. The recording medium according to claim 35, further comprising a program for sorting the displayed name data based on predetermined criteria and a program for selecting a pattern for display.

37. The recording medium according to claim 34, further comprising a program for designating a displayed pattern for sewing.

38. The recording medium according to claim 34, wherein the program for canceling the reading of data has subroutines for execution when reading pattern display data, reading sewing data and between the preceding activities.

39. The recording medium according to claim 35, wherein the program for canceling the reading of data has subroutines for execution when reading pattern name data, reading pattern display data, reading sewing data and between the preceding activities.

* * * * *